United States Patent [19]

Lucke

[11] 4,277,867

[45] Jul. 14, 1981

[54] APPARATUS FOR THE CONTINUOUS DELIVERY OF A YARN OR THE LIKE IN LOOSE FORM

[75] Inventor: Florian Lucke, Mengen, Fed. Rep. of Germany

[73] Assignee: Lucke Apparate-Bau GmbH, Mengen, Fed. Rep. of Germany

[21] Appl. No.: 88,351

[22] Filed: Oct. 26, 1979

[30] Foreign Application Priority Data

Oct. 31, 1978 [DE] Fed. Rep. of Germany ..... 2847291

[51] Int. Cl.[3] ..... D02G 1/20; D02J 1/12; D02J 1/22

[52] U.S. Cl. ..... 28/220; 28/242; 28/251; 28/281; 68/5 D; 242/47.09

[58] Field of Search ..... 28/281, 220, 242, 251, 28/289; 242/47.08, 47.09, 47.11, 47.12; 68/5 D

[56] References Cited

U.S. PATENT DOCUMENTS

| | | | |
|---|---|---|---|
| 2,936,877 | 5/1960 | Adams et al. | 242/47.09 |
| 3,426,553 | 2/1969 | Erb | 28/281 X |
| 3,683,650 | 8/1972 | Hirschburger | 28/281 X |
| 3,774,384 | 11/1973 | Richter | 28/281 X |
| 4,169,707 | 10/1979 | Gloeckler | 28/281 |

FOREIGN PATENT DOCUMENTS

| | | | |
|---|---|---|---|
| 2411644 | 9/1975 | Fed. Rep. of Germany | 28/281 |
| 2725980 | 12/1978 | Fed. Rep. of Germany | 28/281 |
| 2024271 | 1/1980 | United Kingdom | 242/47.12 |

OTHER PUBLICATIONS

*New Continuous Yarn Shrinking and High-Bulking Machine*, Melliand Textilberichte, 8/1979, p. 675.

*Primary Examiner*—Robert Mackey
*Attorney, Agent, or Firm*—Kenway & Jenney

[57] ABSTRACT

Apparatus for the continuous delivery of a yarn or the like in loose form, comprising a rotatable flyer for inserting the yarn into the flights of at least two rotatingly driven screw spindles which are retained in cantilevered and axially parallel configuration, axially parallel reversing pins being disposed between the spindles, wherein the axes of rotation of the spindles and of the reversing pins extend substantially horizontally and wherein the reversing pins extend beyond the free ends of the spindles into guide rods on which yarn loops, which are delivered from the free spindle ends and are suspended substantially perpendicularly, are gradually advanced by mutual interaction.

9 Claims, 7 Drawing Figures

APPARATUS FOR THE CONTINUOUS DELIVERY OF A YARN OR THE LIKE IN LOOSE FORM

This invention relates to apparatus for the continuous delivery of a yarn or the like in loose form, particularly apparatus of the type in which the yarn or the like can be inserted by means of a rotating flyer into the flights of at least two rotatingly driven screw spindles which are retained in cantilevered and axially parallel configuration and axially parallel reversing pins are disposed between the spindles, as described in Federal Republic of Germany patent specification No. 28 28 535.

The axes of rotation associated with the screw spindles and apparatus according to the above-mentioned Federal Republic of Germany patent specification No. 28 28 535, are oriented substantially vertically downwardly and the yarn conveyed by them is delivered in horizontal loops, loosely and flat, onto a conveyor belt. A yarn delivery of this kind is not suitable in all cases for specific kinds of yarn treatment, for example steaming.

It is an object of the present invention to develop apparatus of the type described in Federal Republic of Germany patent specification No. 28 28 535 so that it can be combined with other yarn processing devices and more particularly enable the yarn which is to be delivered to be temporarily stored, stretched and/or steamed.

The present invention provides apparatus for the continuous delivery of a yarn or the like in loose form, comprising a rotatable flyer for inserting the yarn or the like into the flights of at least two rotatingly driven screw spindles which are retained in cantilevered and axially parallel configuration, axially parallel reversing pins being disposed between the said spindles, wherein the axes of rotation of the said spindles and of the reversing pins extend substantially horizontally and wherein the reversing pins extend beyond the free ends of the spindles into guide rods on which yarn loops, which are delivered from the free spindle ends and are suspended substantially perpendicularly, are gradually advanced by mutual interaction.

This construction more particularly achieves the advantage that yarn loops can be stored in suspended form which facilitates steaming and tension-free haul-off at the end of the guide rods when this is desired.

In this specification the term "yarn" is to be understood to include within its scope other filamentary material such as threads and the like.

The invention will be further described, by way of example only, with reference to the accompanying drawings, in which:

FIG. 1 is a partially sectional side view of a yarn delivery apparatus according to the present invention;

FIGS. 2 and 3 are sectional views taken along the lines 2—2 and 3—3, respectively, in FIG. 1;

Figure 1:
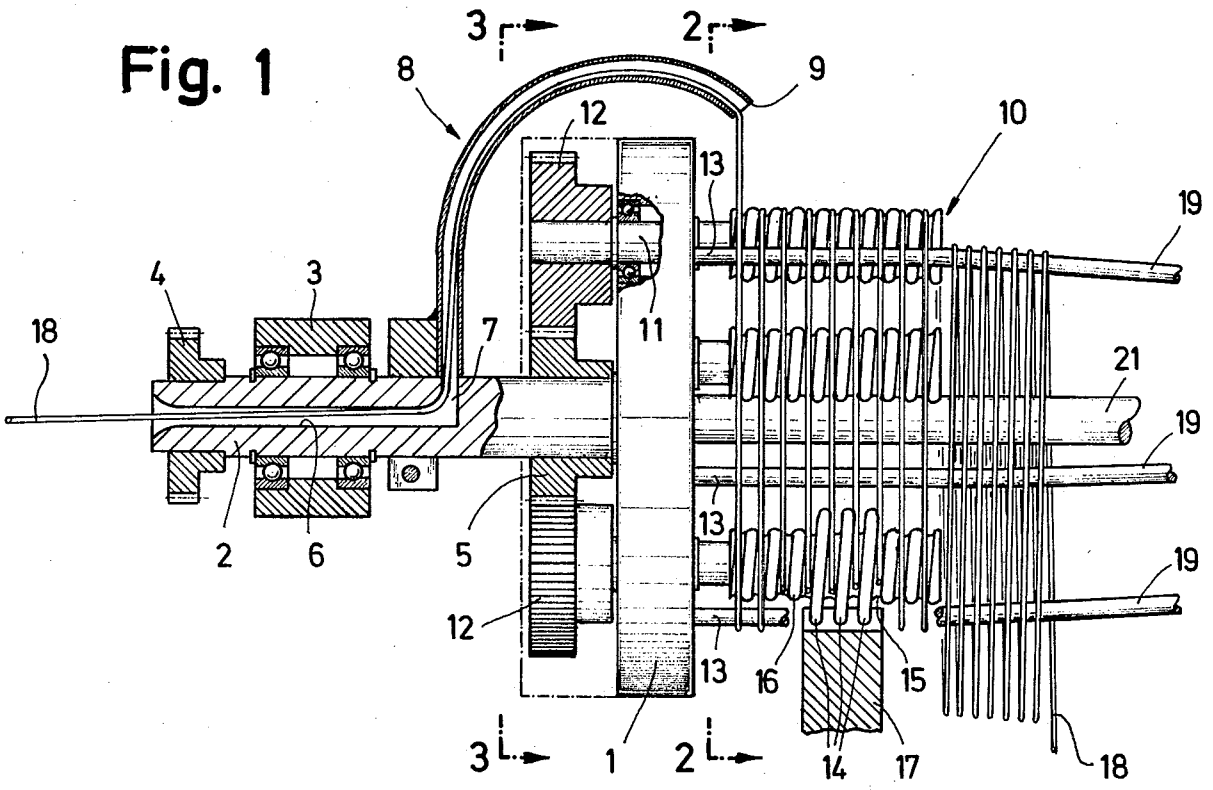

The yarn delivery apparatus shown in FIG. 1 includes a bearing shaft 2, rotationally supported in a stationary bearing 3, and connected at its free end to a bearing plate 1 so as to be rotatable about its longitudinal axis. Two spur gears are non-rotationally mounted on the bearing shaft 2, namely a driving gear 4 at one end and a spur gear 5 near the bearing plate 1. The bearing shaft 2 has a concentric blind bore 6 which merges at its end with a radial bore 7 which joins a tubular flyer 8 which projects radially from the bearing shaft 2 and is fixedly connected thereto. The flyer is curved so that its free end 9 terminates on the right of the bearing plate 1 as shown in FIG. 1.

Five screw spindles 10 are rotatably supported at equal angular distances in the bearing plate 1, concentrically with the bearing shaft 2 (FIG. 2), and the axes of rotation of the spindles 10 extend horizontally, parallel with the bearing shaft 2. The screw spindles 10 are disposed on the side of the bearing plate 1 which is opposite to the bearing shaft 2. Extensions 11 of the screw spindles 10, extending through the bearing plate 1, are non-rotationally coupled to gear wheels 12 which mesh with the spur gear 5. The spur gear 5 and the gear wheels 12 have the same number of teeth.

Reversing pins 13 are recessed into the bearing plate 1 between the spindles 10.

In one of the screw spindles 10 (at the bottom of FIG. 1), the shoulders 14 between adjacent flights 15 of the screw spindle have a larger radius than the shoulders 16 in the remaining region of the spindle. A special holder 17, whose shape at the end nearest to the screw spindle is adapted to the spindle circumference, bears on the enlarged shoulders 14. The holder 17 prevents rotational movement of the bearing plate 1 about the axis of the rotation of the bearing shaft 2.

In operation, the bearing shaft 2 is set into rotation via the driving gear 4 by means of a drive, not shown in FIG. 1, so that by virtue of the mutual engagement of the gear wheels 5 and 12 the screw spindles 10 rotate at the same rotational speed.

Figure 2:
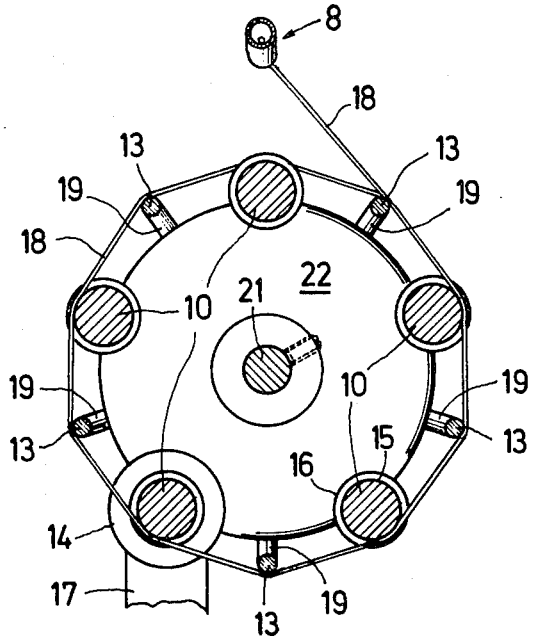
Figure 3:
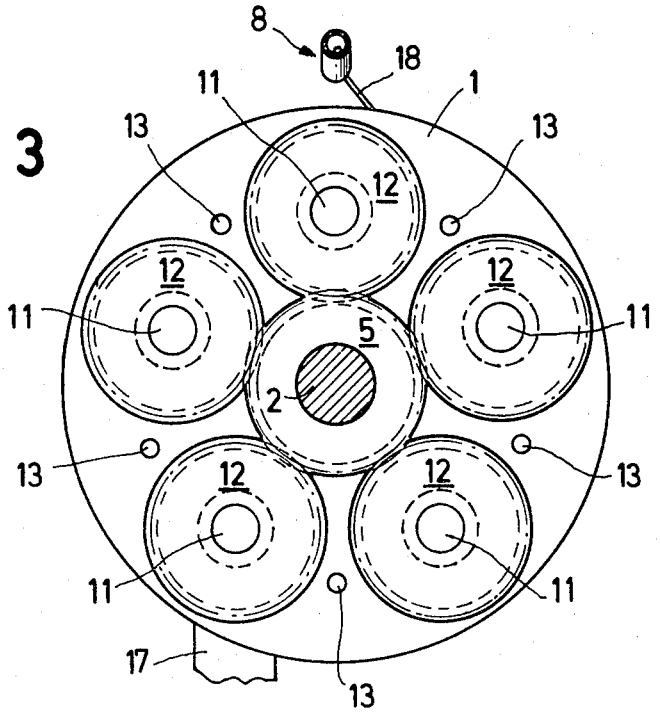

A yarn 18, thread or the like is supplied through the blind bore 6, the bore 7 and the flyer 8 and is inserted into corresponding screw flights 15 of the spindles 10 in the course of rotation of the flyer 8. Rotation of the flyer 8, which is in the sense opposite to that of the screw spindles in the illustrated embodiment, causes the yarn 18 to be placed around all the spindles 10 and the yarn assumes an approximately circular configuration defined not only by the screw spindles 10 but also by the reversing pins 13 (FIG. 2).

When the flyer 8, in the course of its rotating motion, reaches a spindle 10 in which it has inserted the yarn in the course of the preceding rotation, the spindle will also have performed a full rotation due to the synchronization of movement. Accordingly, the thread will have been transported in the direction towards the free end of the spindle by the amount of one flight pitch so that the flight in the insertion region is again free for the reception of the yarn. This process is repeated on all screw spindles. In this manner the yarn extends in the form of substantially concentric circles over the entire length of the screw spindles 10 and the distance between the adjacent yarn layers corresponds to the pitch of the screw spindles.

At the ends of the spindles 10 situated on the right in FIG. 1, the yarn is finally released by the rotating spindles, such release taking place successively on the individual spindles. As shown, the reversing pins 13 are extended into guide rods 19 (see also FIG. 4). These guide rods 19 converge conically in the direction towards their ends which are remote from the screw spindles.

Figure 4:
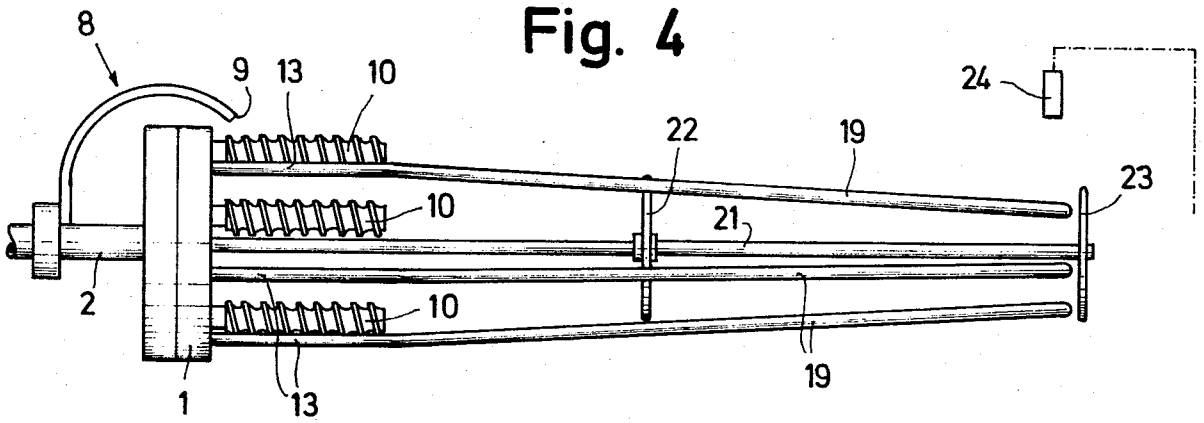
FIG. 4 shows the apparatus of FIG. 1 wherein the guide rods thereof form a yarn magazine.
Figure 5:
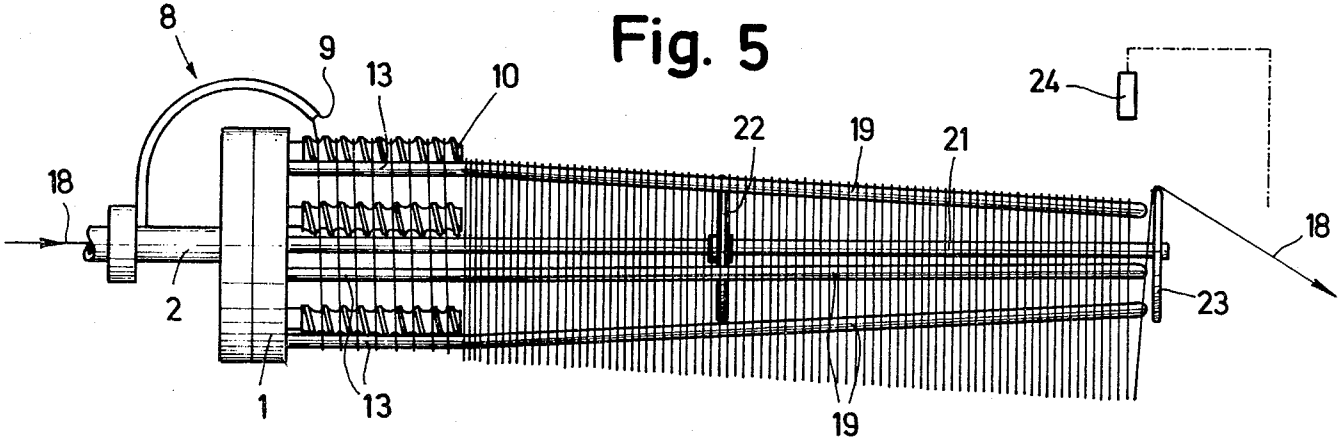
FIG. 5 shows the magazine of FIG. 4 loaded with yarn.

In operation, the yarn loops, which are paid off from the free ends of the screw spindles 10, are freely and successively suspended from the guide rods 19 and by virtue of the action of succeeding loops gradually advance to the free ends of the guide rods due to mutual interaction, i.e. to the right in FIGS. 1 and 4. In this way, a substantial number of yarn loops will finally be suspended in closely adjacent configuration and perpendicularly from the guide rods 19 which therefore function as a yarn magazine.

The guide rods 19 shown in the illustrated embodiment are slightly resilient and their free ends have a tendency to approach each other. A rod 21, which is mounted on the bearing plate 1 in a cantilevered manner, is arranged along the central axis of the magazine cage formed by the guide rods 19. A circular adjusting disc 22 by means of which the conicity of the guide rods 19 can be adjusted, is slidably supported on the rod 21. If desired, notches can be provided at specific distances on the rod 21 into which notches the disc 22 can engage.

At its free end the rod 21 supports a known payoff collar 23 over which the yarn 18 can be hauled off without tension from the end of the stored supply.

A photoelectric cell 24, adapted to respond to the yarn loops, is disposed at a specific distance from the free end of the guide rods 19 in order to coordinate the haul off speed with the speed by which the perpendicularly suspended yarn loops advance on the guide rods 19. As soon as the yarn loops enter the monitoring region of the photoelectric cell, the drive of the bearing shaft 2 and therefore the advance of the yarn loops on the guide rods 19 is shut down by the electrical pulse thus triggered. The drive of the bearing shaft 2 can be switched on again by means of an adjustable delay relay after a desired quantity of yarn has been drawn off.

Figure 6:
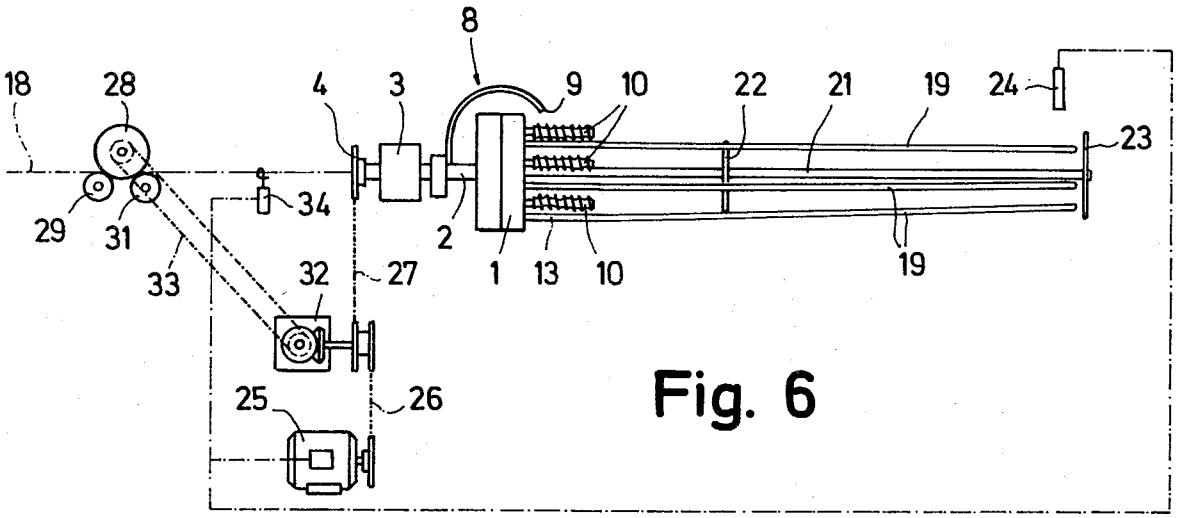
FIG. 6 shows the apparatus of FIGS. 1 and 4 forming part of a stretching device.

FIG. 6 shows another embodiment wherein the delivery apparatus with the screw spindles 10 and the guide rods 19, which form the yarn magazine, is driven at constant speed by a motor 25 via V-belts 26, 27, i.e. the flyer 8 also rotates at a specific uniform speed and places the yarn on the screw spindles 10. The delivery apparatus in FIG. 6 is preceded by a feed roller 28 on which two contact rollers 29, 31 bear. The yarn 18 is guided between the feed roller 28 on the one hand and the contact rollers 29, 31 on the other hand and is drawn off in known manner from a yarn supply which is not shown. The feed roller 28 is also driven at a constant speed by the motor 25 via an intermediate transmission 32, more particularly an adjustable transmission, and a V-belt 33. The rotational speed of the flyer 8 is adapted to the haul-off speed of the yarn defined by the feed roller 28 and in such a way that the yarn 18 is stretched between the feed roller 28 and the flyer 8, i.e. the yarn is coiled on the spindles 10 slightly faster by the flyer 8 than it is drawn off from the yarn supply by the feed roller 28. It has been found that the yarn passing through the numerous screw flights of the spindles 10 is subjected to a retaining force, due to friction, which is sufficiently high so that by means of the flyer 8 it is possible for pull to be applied to the yarn downstream of the roller 28 to result in stretching. The delivery apparatus of this system is therefore also part of a stretching device.

The flyer 8 rotates at uniform velocity because of the constant speed of the motor 25. In order to alter the degree of stretch the speed of the feed roller 28 can be suitably varied by means of the adjustable transmission 32. In the region between the feed roller 28 and flyer 8, the yarn 18 passes through a known thread monitor 34 by means of which the motor 25 is switched off in the event of thread breakage. FIG. 6 also indicates the connection between the photoelectric cell 24 and the drive motor 25. If the yarn magazine formed by the guide rods 19 is overfilled, the flyer 8, the screw spindles 10 and the feed roller 28 will be simultaneously switched off.

Figure 7:
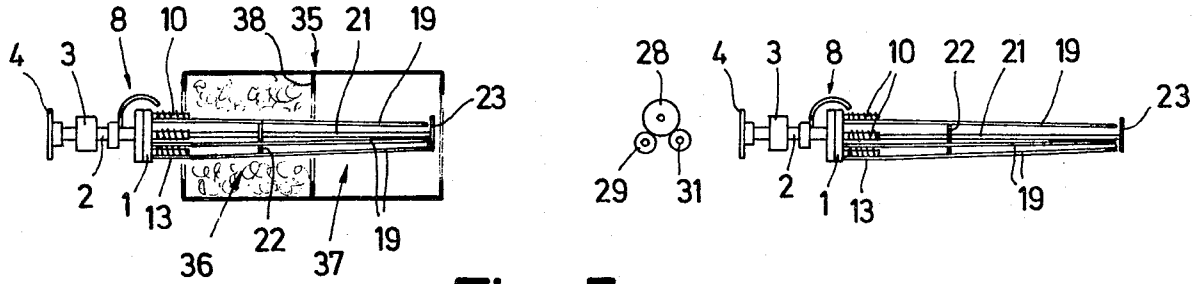
FIG. 7 shows the arrangement of FIG. 6 preceded by a steaming device.

In FIG. 7, the apparatus as shown in FIGS. 1 to 5 is combined with a steaming device. As shown, the magazine cage formed by the guide rods 19 extends through a casing 35 which surrounds a steaming zone 36 and a cooling zone 37.

Both zones are separated from each other by a bulkhead 38. Yarn is inserted on the left-hand side of the casing via the delivery apparatus including the flyer 8 and the screw spindles 10. Steamed and cooled yarn re-emerges through an aperture on the right-hand side of the casing. Hot steam is introduced in known manner into the steaming zone 36. Steam can also be introduced via the rod 21 (FIGS. 1 and 4) which is constructed as a tube so that the yarn loops suspended from the rods 19 can also be steamed from the inside. As shown in FIG. 7, after leaving the casing 35, the steamed and cooled yarn is supplied to a further delivery apparatus including a flyer 8 and screw spindles 10 upstream of which there is disposed a feed roller 28, similar to that shown in FIG. 6, co-operating with contact rollers 29 and 31 for the purpose for stretching the yarn. After steaming and stretching, the yarn is collected on the guide rods 19 and drawn off without tension via the delivery collar 23.

It is known that yarn shrinks on being steamed and the loops suspended from the guide rods 19 contract and have a smaller diameter. Suitable adjustment of the adjusting disc or discs 22 enables the conical configuration of the guide rods 19 to be suitably adapted to the degree of shrinkage.

Stretching of the yarn 18 in FIG. 7 is performed with horizontally extending rotational axes of the flyers 8 and of the spindles 10. In a modified embodiment of the invention these axes of rotation can also extend in another direction, for example vertically downwards as described in the previously mentioned Federal Republic of Germany Patent Specification No. 28 28 535, because this has no effect on stretching.

If the delivery apparatus including the flyer 8 and screw spindles 10 is used in combination with a feed roller 28, functioning as a traction device, it may be possible for the magazine formed by the rods 19 to be omitted.

I claim:

1. Apparatus for the continuous delivery of a yarn in loose form comprising, in combination, a bearing support having a plurality of axially parallel screw spindles rotatingly mounted thereon and a plurality of axially parallel reversing pins mounted thereon between the spindles, the axes of the spindles and reversing pins extending in substantially horizontal directions and the reversing pins extending beyond the ends of the spindles to form guide rods, a flyer rotatable about the bearing support and adapted for depositing a yarn in loops over the reversing pins and into the flights of the spindles, and means for rotating the spindles about their respective axes in directions to cause the yarn loops to progress to and beyond the ends of the spindles on to the guide rods, whereby the yarn loops become substantially perpendicularly suspended on and gradually advanced along the guide rods by mutual interaction.

2. Apparatus according to claim 1, in which the guide rods converge conically in the direction away from the spindles.

3. Apparatus according to claim 2, including means mounted on the bearing support and bearing on the guide rods for adjusting the conicity thereof.

4. Apparatus according to claim 1, including a pay-off collar mounted on the bearing support adjacent the ends of the guide rods remote from the spindles and adapted to permit tension-free haul-off of the yarn loops from the guide rods.

5. Apparatus according to claim 1, including light responsive means located and adapted for detection of the presence of yarn loops at the ends of the guide rods remote from the spindles, and means operable by the light responsive means upon said detection to arrest the operation of said means for rotating the spindles.

6. Apparatus according to claim 1, including a driven feed roller and at least one contact roller upstream of the flyer and adapted for feeding the yarn thereto, and means for driving the feed roller and flyer at relative speeds which subject the yarn to stretching therebetween.

7. Apparatus according to claim 6, in which the means for rotating the spindles are adapted for rotating the flyer, and including a transmission connected between said means and the feed roller.

8. Apparatus according to claim 7, in which the transmission is adjustable.

9. Apparatus according to claim 1, including a casing surrounding at least a portion of the guide rods, and means to introduce steam into the casing.

* * * * *